US009933224B2

(12) United States Patent
Dorne et al.

(10) Patent No.: US 9,933,224 B2
(45) Date of Patent: Apr. 3, 2018

(54) MODULAR GUN SILENCER

(71) Applicants: Robert Lindsey Dorne, Irvine, CA (US); Brenda Carol Dorne, Irvine, CA (US)

(72) Inventors: Robert Lindsey Dorne, Irvine, CA (US); Brenda Carol Dorne, Irvine, CA (US)

( * ) Notice: Subject to any disclaimer, the term of this patent is extended or adjusted under 35 U.S.C. 154(b) by 0 days.

(21) Appl. No.: 15/665,660

(22) Filed: Aug. 1, 2017

(65) Prior Publication Data

US 2018/0058789 A1 Mar. 1, 2018

Related U.S. Application Data

(60) Provisional application No. 62/370,594, filed on Aug. 3, 2016, provisional application No. 62/500,383, filed (Continued)

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30

(Continued)

(56) References Cited

U.S. PATENT DOCUMENTS 5,164,535 A 11/1992 Leasure
6,575,074 B1 6/2003 Gaddani (Continued)

FOREIGN PATENT DOCUMENTS

CN 104713414 A 6/2015
EP 3 023 729 B1 11/2014

(Continued)

OTHER PUBLICATIONS

Home Made Moderator, dated Jan. 19, 2016, Airgunnation, http://www.argunnation.com/forum/discusson/other-accesories/, 15 pages.

(Continued)

*Primary Examiner* — Jeremy Luks
(74) *Attorney, Agent, or Firm* — Knobbe, Martens, Olson & Bear LLP

(57) ABSTRACT

A modular silencer includes an outer tube and a plurality of chamber separators suspended through a tensile force within a bore of the outer tube and defining chambers between each pair of chamber separators in the silencer. An outer edge of the chamber separators is spaced apart from an inner surface of the tube to allow gas equalization between the chambers. A plurality of tube portions separate the chamber separators from each other and from the proximal and distal ends of the silencer assembly. The tube portions define a continuous center tube suspended in tension within the outer tube and through which the projectile travels. The tube portions have can have angled openings through which gas discharge exits into the chambers. Rotatable sleeves can be disposed over the tube portions to further disrupt gas flow and dissipate heat and sound. A carbon fiber sleeve can be disposed over the outer tube to inhibit burn injuries from contacting the silencer.

20 Claims, 16 Drawing Sheets

Related U.S. Application Data on May 2, 2017, provisional application No. 62/521, 707, filed on Jun. 19, 2017.

(58) Field of Classification Search
USPC ..... 181/223
See application file for complete search history.

(56) References Cited

U.S. PATENT DOCUMENTS

| | | | | |
|---|---|---|---|---|
| 8,096,222 | B2 | 1/2012 | Silvers | |
| 8,453,789 | B1 | 6/2013 | Honigmann | |
| 8,459,405 | B1 | 6/2013 | Dueck | |
| 8,505,680 | B2 | 8/2013 | Dueck | |
| 8,584,794 | B2 | 11/2013 | Dueck | |
| 8,973,481 | B2 | 3/2015 | Dueck | |
| 9,038,771 | B1 | 5/2015 | Mueller | |
| 9,091,502 | B1 * | 7/2015 | Morrison | F41A 21/30 |
| 9,482,484 | B2 | 11/2016 | Barney | |
| 2008/0251060 | A1 | 10/2008 | Thurber | |
| 2011/0297477 | A1 | 12/2011 | Koumbis | |
| 2012/0291614 | A1 | 11/2012 | Koumbis | |
| 2014/0224574 | A1 | 8/2014 | Latka | |
| 2016/0187093 | A1 | 6/2016 | Barrett | |
| 2016/0209151 | A1 | 7/2016 | Smith | |
| 2017/0115084 | A1 | 4/2017 | Hailey et al. | |
| 2017/0191779 | A1 | 7/2017 | Myers | |

FOREIGN PATENT DOCUMENTS

| | | | |
|---|---|---|---|
| GB | 356224 | | 8/1931 |
| GB | 2 350 881 | A | 12/2000 |
| UA | 101643 | U | 9/2015 |
| WO | WO 2014/135639 | A1 | 9/2014 |
| WO | WO 2016/102534 | A1 | 6/2016 |

OTHER PUBLICATIONS

Gun City: Ranger 10/22 Carbon Tension Barrel With Full Barrel Silencer, https://www.guncity.com/ranger-10-22-carbon-tension-barrel-with-full-barrel-silencer-311061, the Wayback Machine dated Apr. 5, 2015.

Johnson, Advanced Rifle Integral External Suppressor (ARIES) System, NFA/Suppressors/Class III, http://www.thefirearmblog.com/blog/2009/10/07/advanced-rifle-integral-external-supressor-aries-system/, dated Oct. 7, 2009.

PCT International Search Report and Written Opinion of The International Search Authority dated Dec. 20, 2017, PCT Application No. PCT/US2017/044948, 12 pages.

* cited by examiner

MODULAR GUN SILENCER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

This invention relates broadly to gun silencers, and ore particularly to a modular gun silencer that can be readily assembled and disassembled in the field in a variety of different configurations.

Description of the Related Art

There are a number of gun silencers on the market having various baffles and intermediate spacers mounted in outer tubes thereof. However, existing silencers have a variety of drawbacks. For example, many of these gun silencers do not achieve adequate noise attenuation. Also, some of them are quite heavy, thereby disturbing gun balance and preventing automatic and semiautomatic weapons from properly cycling. Yet another difficulty with many types of existing gun silencers is that they are designed to work well only with particular sizes of ammunition. That is, for example, one type of silencer may work well for 38 caliber ammunition, but not work well for 22 caliber ammunition. In addition, many prior art gun silencers do not significantly reduce muzzle flash.

Additionally, existing gun silencers include an undue number of different types of parts and/or are difficult to assemble, thereby making them expensive to manufacture and quite costly for ultimate consumers.

Yet another difficulty with most prior art silencers is that they employ "wipes" or other components that require replacement after as few as 20 or 30 rounds. Further, existing silencers often suffer from heat related distortions and baffle strikes during use, which can degrade the performance of the silencer and negatively affect the trajectory of the projectile. Additionally, existing silencers typically reduce sound to only about 138 decibels.

Member of the armed services often suffer from some degree of hearing loss during tours of duty due to the noisegenerated by firearms during battles. Existing silencers do not sufficiently reduce such firearm noise or inhibit such hearing loss.

SUMMARY

It is, therefore, an object of this invention to provide a durable gun silencer which adequately reduces gun noise while simultaneously cycling automatic and semiautomatic guns, preventing muzzle flash, not being unduly heavy, working with most sizes of ammunition, having a small number of different parts, being easily assembled, and being relatively inexpensive to manufacture and easy to disassemble and clean. Additionally, it is an object of the invention for the modular silencer to be easily serviceable (e.g., to replace one or more parts of the silencer). Such improvements can help prevent hearing injuries to members of the armed services during armed conflicts.

In accordance with one aspect, the gun silencer optionally includes an outer carbon fiber sleeve that inhibits injuries burns) to users from prolonged or constant use of the silencer while operating a weapon (e.g., automatic or semi-automatic guns or rifles).

In accordance with another aspect, a modular noise suppressor (e.g., silencer) for use with firearms e.g., guns, rifles, etc.) is provided. The silencer includes an outer tube having at least one chamber separator removably disposed in a tube bore thereof, the chamber separator defining a beveled diversion passage pair adjacent to and leading into a chamber separator bore, with each diversion passage of the diversion passage pair being beveled in a discharge direction and being directed substantially radially. The diversion passages of the diversion passage pairs are directed from and toward ports in intermediate spacers positioned between adjacent chamber separators which lead to circumferential, or outer, chambers. The bore of the outer tube is optionally threaded along the entire length thereof and front and rear faces of the chamber separators are optionally knurled. There are a plurality of chamber separators and intermediate spacers screwed together within the outer tube by end cap members screwed in the threads of the tube bore.

In accordance with one aspect, a modular gun silencer or noise suppressor is provided. The silencer includes a tube extending from a proximal end configured to couple to a gun barrel at a muzzle thereof to a distal end. The silencer also comprises a modular assembly comprising a plurality of chamber separators axially spaced apart within a bore of the tube. The chamber separators are suspended within the tube under a tension force, each pair of adjacent chamber separators defining a chamber therebetween.

The silencer may optionally be arranged such that an outermost edge of each of the chamber separators is spaced apart from an inner surface of the tube by a gap to facilitate gas flow between the chambers, thereby facilitating gas equalization between chambers within the tube to thereby increase noise suppression. Optionally, the gap can be approximately 0.001 inches (about 25.4 microns).

The silencer may optionally be arranged such that each of the plurality of chamber separators is cone shaped and tapers toward the proximal end of the tube.

The silencer may optionally be arranged to further include a plurality of intermediate tube portions, each intermediate tube portion disposed between and interconnecting adjacent chamber separators, the chamber separators having openings through which at least a portion of an intermediate member extends. The plurality of intermediate tube portions releasably couple to each other along an axis. Each of the plurality of the tube portions has a central bore along its length and one or more openings extending through a wall of the intermediate tube portion configured to allow a gas to pass from the central bore into the chamber that surrounds the intermediate tube portion.

The silencer may optionally be arranged such that the one or more openings that extend through the wall of the intermediate tube portion are oriented at an angle relative to a central axis of the intermediate tube portion. Optionally, said angle is approximately 37 degrees.

The silencer may optionally be arranged to further include a sleeve rotatably disposed about one or more of the plurality of intermediate tube portions. The sleeve includes one or more openings through a wall of the sleeve configured to allow the gas to pass through the sleeve into the chamber surrounding the intermediate tube portion. The sleeve is configured to rotate relative to the intermediate tube portion to dissipate heat and sound generated by firing a bullet through the silencer.

The silencer may optionally be arranged such that the one or more openings that extend through the wall of the sleeve are oriented at an angle relative to a central axis of the intermediate tube portion. Optionally, said angle is approximately 37 degrees.

The silencer may optionally be arranged to further include a proximal expansion chamber between an adapter removably coupleable to a proximal end of the tube and a first of the plurality of chamber separators. A proximal tube portion is disposed between and coupled to the adapter and first chamber separator, the proximal tube portion removably coupled to a first of the plurality of intermediate tube portions.

The silencer may optionally be arranged to further include a distal expansion chamber between a last of the plurality of chamber separators and an end cap removably coupleable to a distal end of the tube. A distal tube portion is disposed between and coupled to the end cap and the last chamber separator. The distal tube portion is removably coupled to a last of the plurality of intermediate tube portions, wherein a distal end of the distal tube portion extends through an opening in the end cap such that it protrudes from the end cap.

The silencer may optionally be arranged such that the end cap further includes a plurality of openings on a perimeter surface thereof through which gas can exit from the distal expansion chamber. Optionally, the plurality of openings extend at an angle relative to an axis of the end cap. Optionally, the angle is approximately 37 degrees.

The silencer may optionally be arranged to further include a nut configured to couple to the distal end of the distal tube portion that protrudes from the end cap so that the end cap is disposed axially between the nut and the distal expansion chamber. An amount of the tension force applied to the modular assembly depends on the degree to which the nut is rotated (e.g., threaded) onto the distal end of the distal tube portion.

The silencer may optionally be arranged such that the proximal tube portion, plurality of intermediate tube portions, and distal tube portion are sequentially threadably coupled to each other and together define a continuous bore configured to receive a bullet therethrough during use. A proximal end of the proximal tube portion is threadably coupled to a threaded coupling of the adapter, the threaded coupling defining a bore therethrough that aligns with a bore of the proximal tube portion.

The silencer may optionally be arranged to further include an outer sleeve disposed over the tube. The outer sleeve is made of carbon fiber material and configured to inhibit heat transfer from the tube during use of the silencer, thereby inhibiting burn injuries from contact with the outer sleeve.

In accordance with another aspect a modular gun silencer or noise suppressor is provided. The silencer includes a tube extending from a proximal end configured to couple to a gun barrel at a muzzle thereof to a distal end. The silencer also includes a modular assembly.

The modular assembly comprises an adapter removably coupleable to the proximal end of the tube, the adapter comprising a threaded coupling defining a bore therethrough. The modular assembly also comprises an end cap removably coupleable to the distal end of the tube, the end cap comprising a central opening therethrough.

The modular assembly also comprises a plurality of chamber separators axially spaced apart within a bore of the tube, an outer perimeter of each chamber separator spaced from a surface of the bore by a gap, each pair of adjacent chamber separators defining a chamber therebetween.

The modular assembly also comprises a proximal tube portion disposed between the adapter and a first of the plurality of chamber separators, a proximal expansion chamber defined between the adapter and the first of the plurality of chamber separators, the proximal tube portion threadably coupled to the threaded coupling of the adapter and having a central bore along its length.

The modular assembly also comprises a plurality of intermediate tube portions, each intermediate tube portion disposed between and interconnecting adjacent chamber separators, the plurality of tube portions threadably coupleable to each other along an axis, each of the plurality of the intermediate tube portions having a central bore along its length and one or more openings extending through a wall of the intermediate tube portion configured to allow gas to pass from the central bore of the intermediate tube portion into the chamber that surrounds the intermediate tube portion, a first of the plurality of intermediate tube portions threadably coupleable to a distal end of the proximal tube portion.

The modular assembly optionally comprises a plurality of sleeves, each sleeve rotatably disposed about one of the plurality of intermediate tube portions, the sleeve comprising one or more openings through a wall of the sleeve configured to allow gas to pass from the central bore of the intermediate tube portion into the chamber that surrounds the intermediate tube portion, the sleeve configured to rotate relative to the intermediate tube portions.

The modular assembly also comprises a distal tube portion disposed between a last of the plurality of chamber separators and the end cap, a distal expansion chamber defined between the last of the plurality of chamber separators and the end cap, the distal tube portion threadably coupled to a last of the plurality of intermediate tube portions, a distal end of the distal tube portion configured to extend through the central opening in the end cap such that the distal end protrudes from the end cap.

The modular assembly also comprises a nut configured to threadably couple to the distal end of the distal tube portion so that the end cap is disposed axially between the nut and the distal expansion chamber. The proximal tube portion, plurality of intermediate tube portions, and distal tube portion, when threadably assembled define a continuous central bore of the silencer through which a bullet can pass. The nut applies a tension force on the modular assembly based on a degree to which the nut is threaded onto the distal end of the distal tube portion and bears against the end cap. The gap between the plurality of chamber separators and the inner surface of the tube facilitates gas equalization between chambers within the tube to thereby dissipate heat and increase noise suppression during use.

The silencer may optionally be arranged such that the chamber separators are cone-shaped.

The silencer may optionally be arranged such that the gap extends circumferentially about the outer perimeter of each chamber separator. Optionally, the gap can be approximately 0.001 inches (about 25.4 microns).

The silencer may optionally be arranged such that the openings extending through the wall of the intermediate tube portions and the openings extending through the wall of the sleeves are oriented at an angle relative to a central axis of the intermediate tube portions. Optionally, the angle is approximately 37 degrees.

The silencer may optionally be arranged such that the end cap comprises a plurality of openings on a perimeter surface thereof through which gas can exit from the distal expansion chamber. Optionally, the plurality of openings extend at an angle relative to an axis of the end cap. Optionally, the angle is approximately 37 degrees.

The silencer may optionally be arranged to further include an outer sleeve disposed over the tube. The outer sleeve is optionally made of carbon fiber material and configured to inhibit heat transfer from the tube during use of the silencer, thereby inhibiting burn injuries from contact with the outer sleeve.

DETAILED DESCRIPTION

Figure 1:
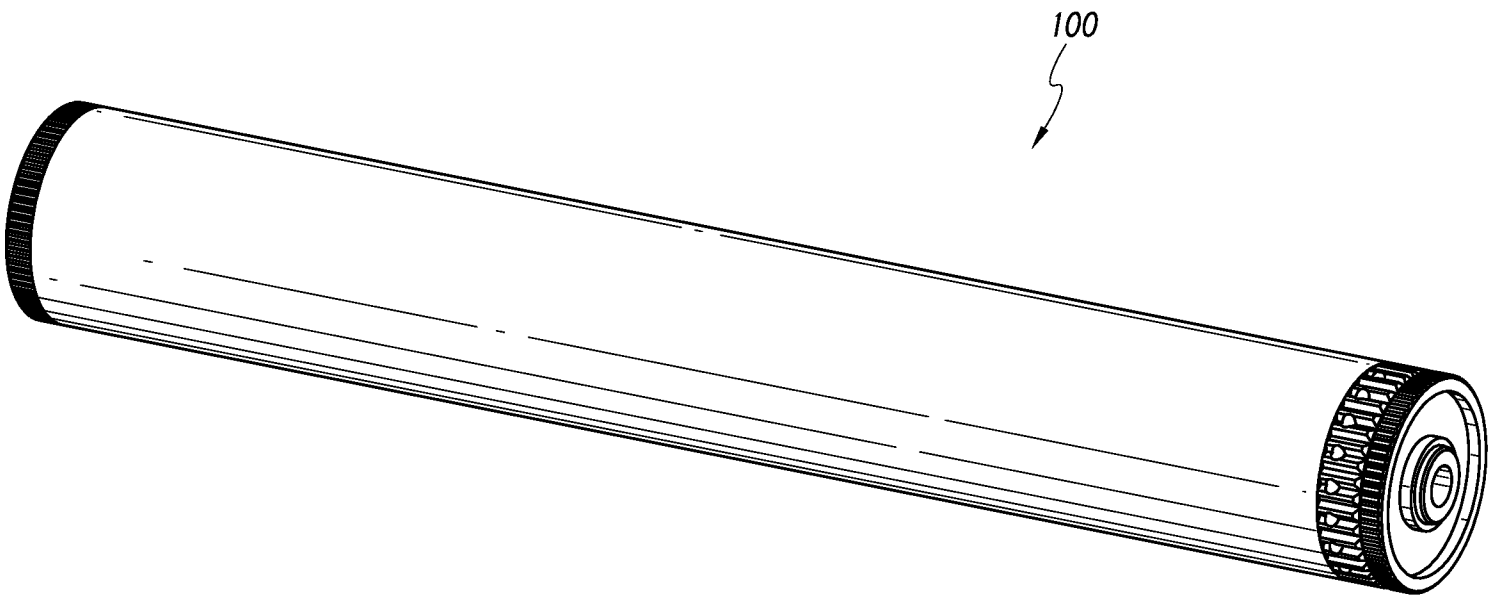
FIG. 1 is a perspective view of a silencer assembly.
Figure 2A:
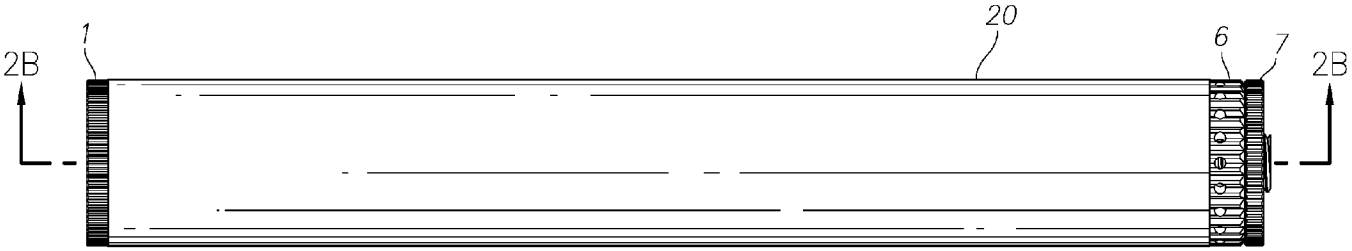
FIG. 2A is a side view of the silencer assembly of FIG. 1.
Figure 2B:
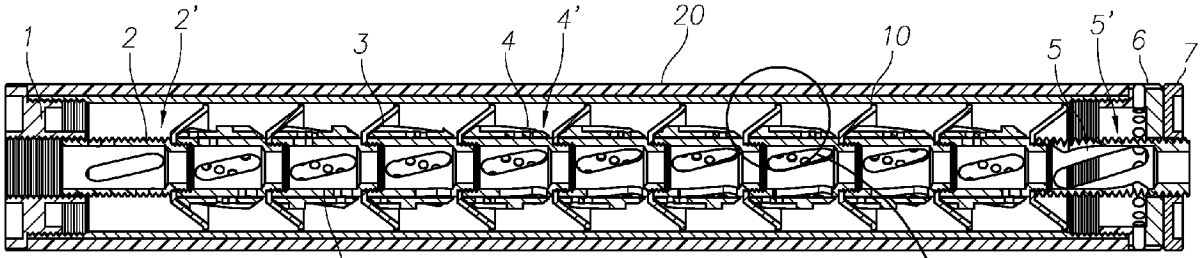
FIG. 2B is a cross-sectional side view of the silencer assembly of FIG. 1.
Figure 2C:
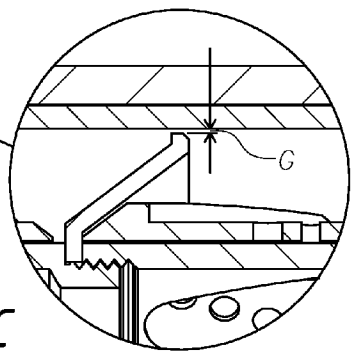
FIG. 2C is an enlarged partial cross-sectional side view of a portion of the assembly in FIG. 2B.
Figure 3:
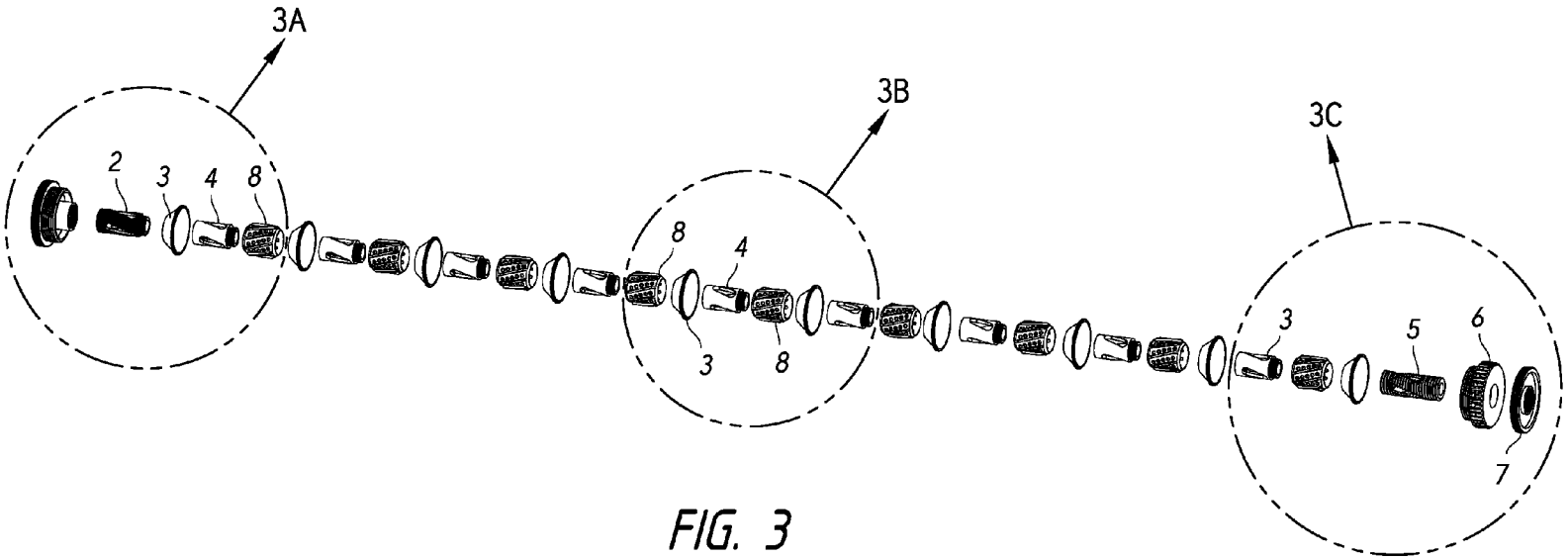
FIG. 3 is an exploded view of the silencer assembly of FIG. 1.
Figure 3A:
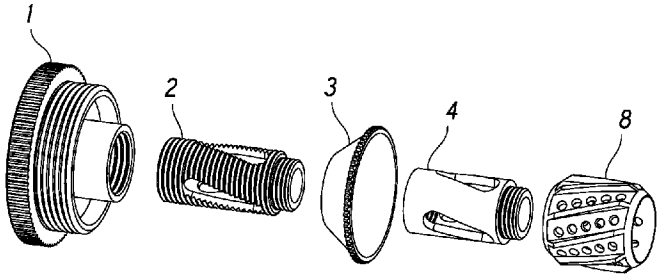
FIG. 3A is an enlarged partial view of a proximal exploded section of the silencer assembly of FIG. 1.
Figure 3B:
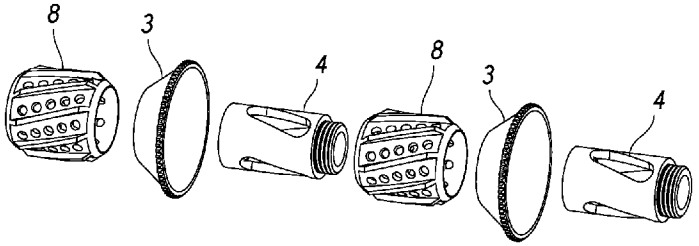
FIG. 3B is an enlarged partial view of a center exploded section of the silencer assembly of FIG. 1.
Figure 3C:
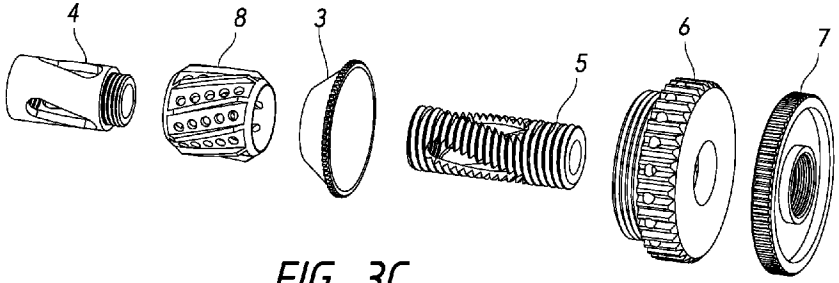
FIG. 3C is an enlarged partial view of a distal exploded section of the silencer of FIG. 1.
Figure 4C:
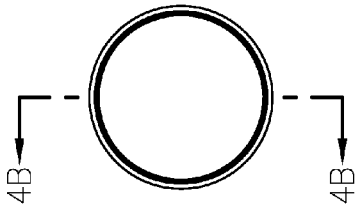
FIGS. 4A-4C are a perspective view and cross-sectional view of a tube of the silencer assembly of FIG. 1.
Figure 4A:
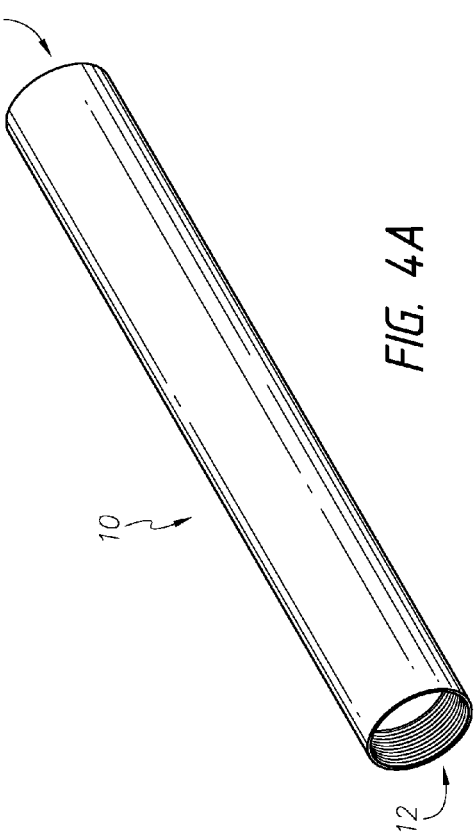
Figure 4B:
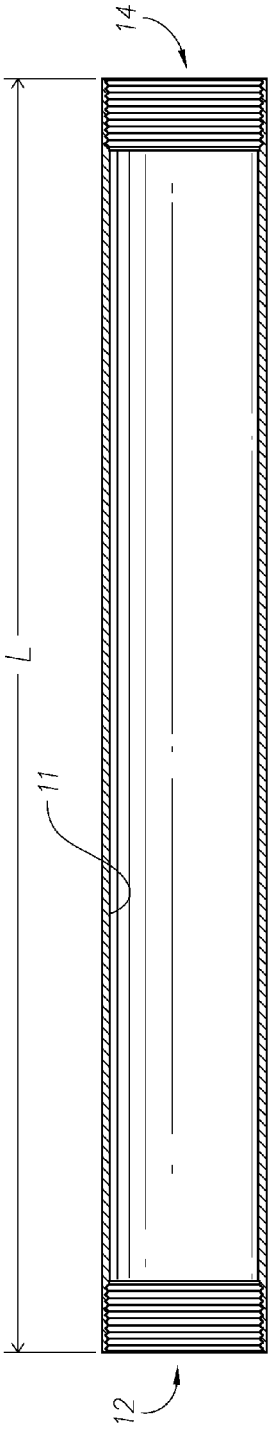
Figure 5B:
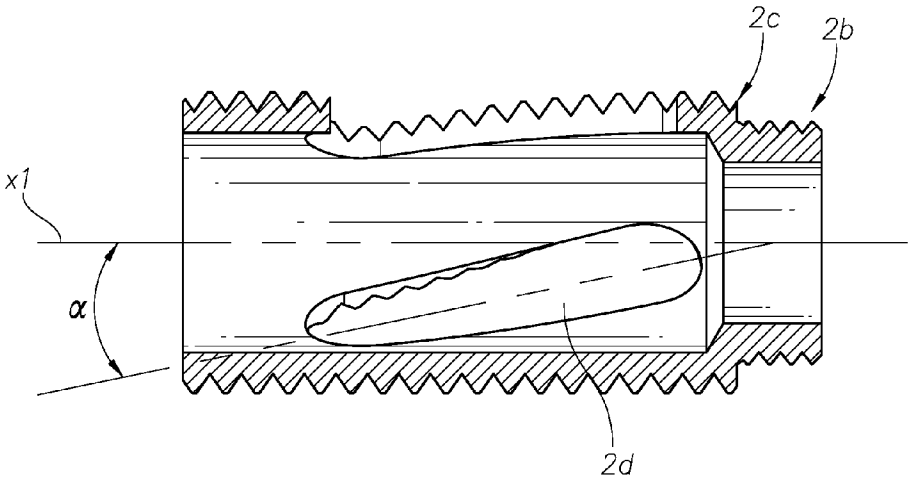
FIGS. 5A-5D are a perspective view and cross-sectional view of a back expansion chamber of the silencer assembly of FIG. 1.
Figure 5A:
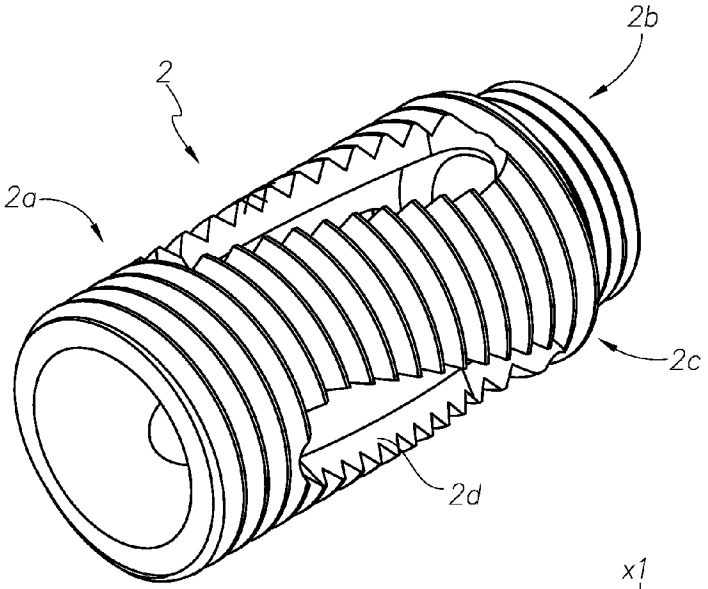
Figure 5D:
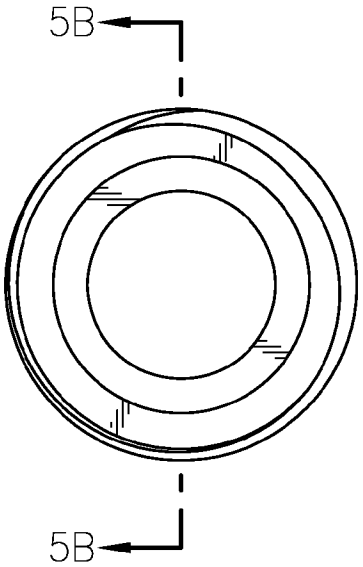
Figure 5C:
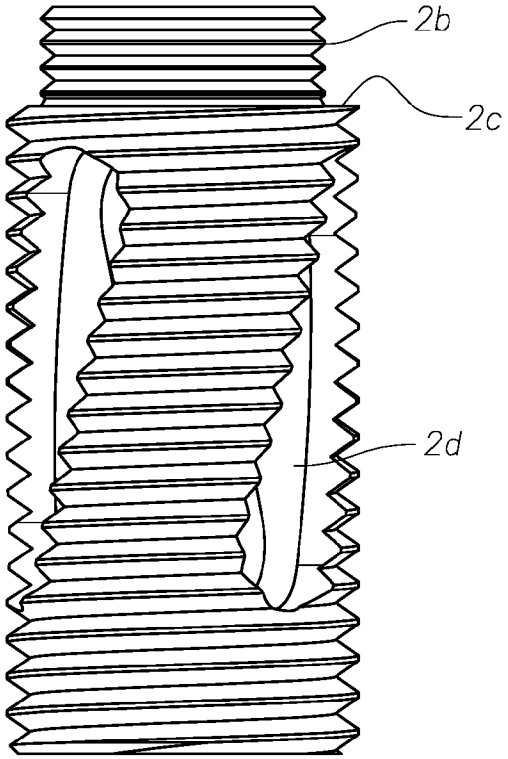
Figure 6C:
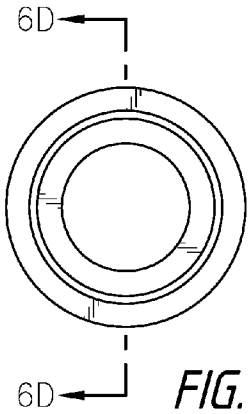
FIGS. 6A-6D are a perspective view and cross-sectional view of a center piece of the silencer assembly of FIG. 1.
Figure 6D:
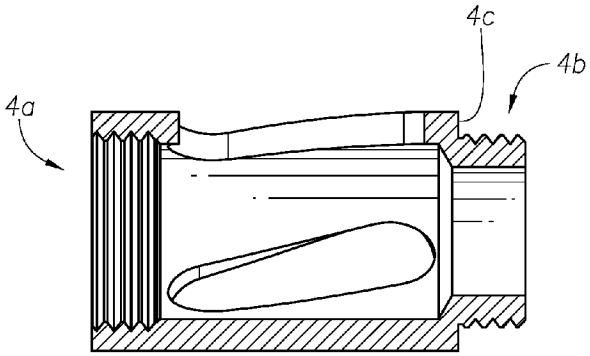
Figure 6A:
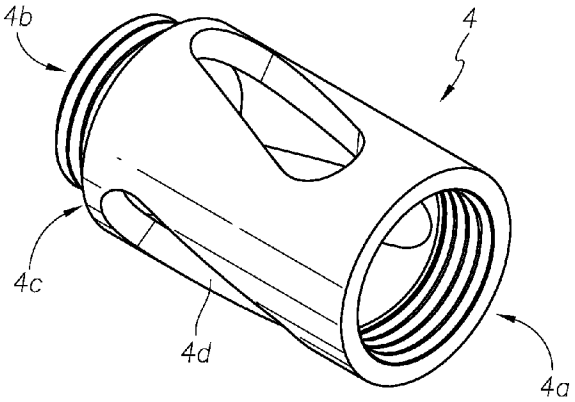
Figure 6B:
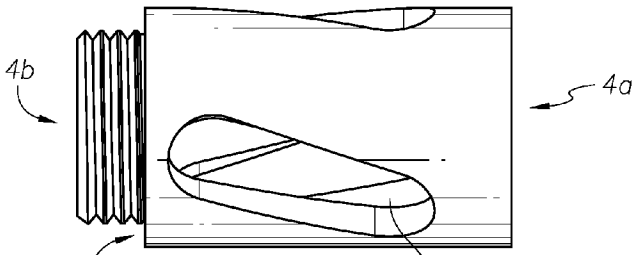
Figure 7A:
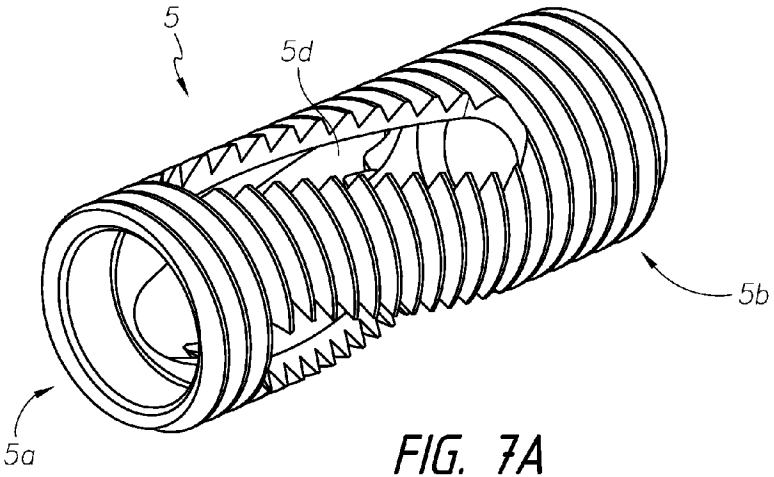
FIGS. 7A-7D are a perspective view and cross-sectional view of a back extension of the silencer assembly of FIG. 1.
Figure 7B:
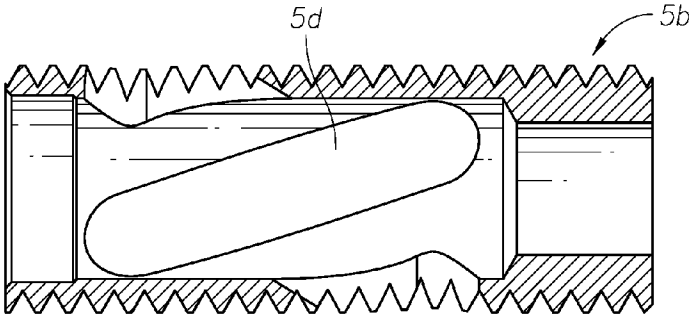
Figure 7D:
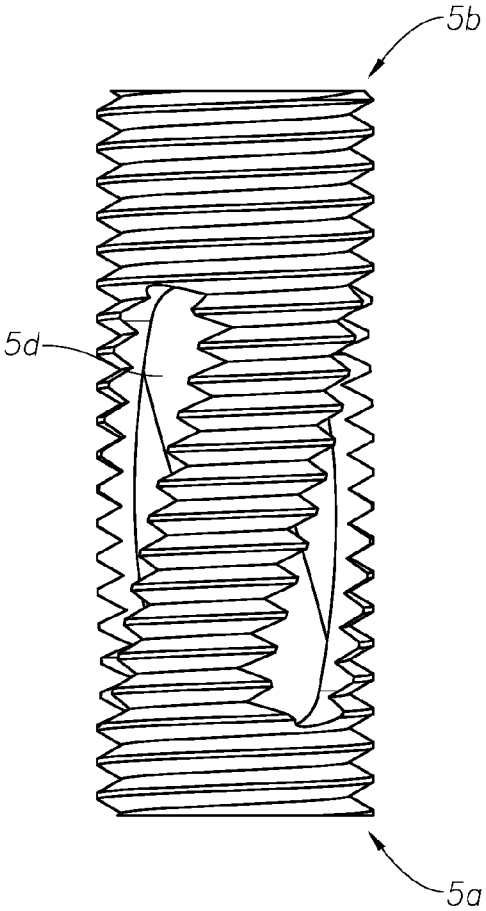
Figure 7C:
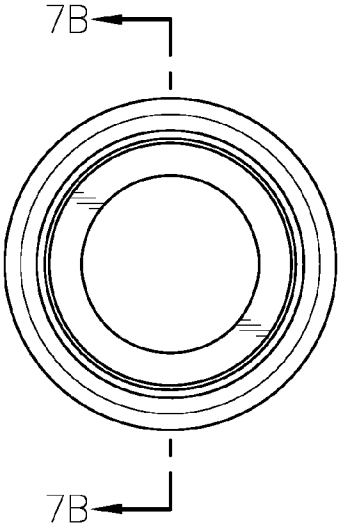
Figure 8B:
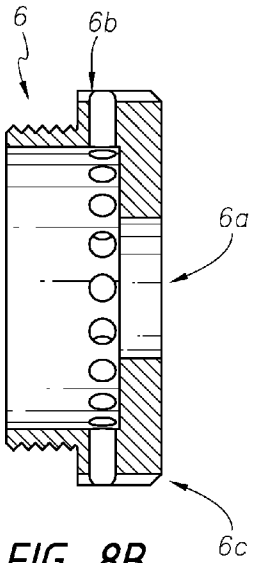
FIGS. 8A-8C are a perspective view and cross-sectional view of an end cap of the silencer assembly of FIG. 1.
Figure 8C:
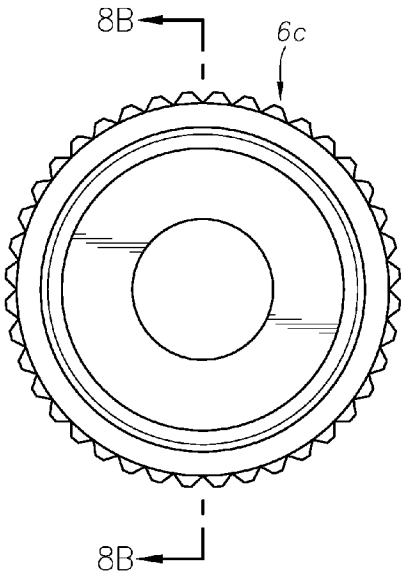
Figure 8A:
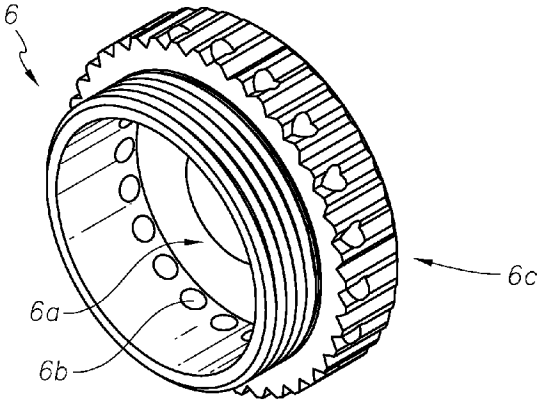
Figure 9B:
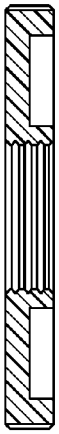
FIGS. 9A-9C are a perspective view and cross-sectional view of a nut of the silencer assembly of FIG. 1.
Figure 9C:
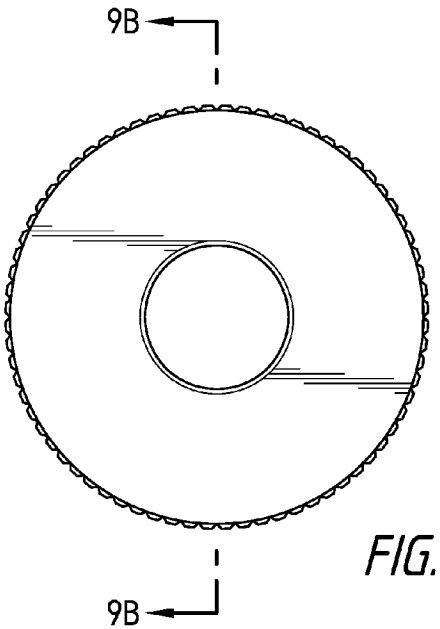
Figure 9A:
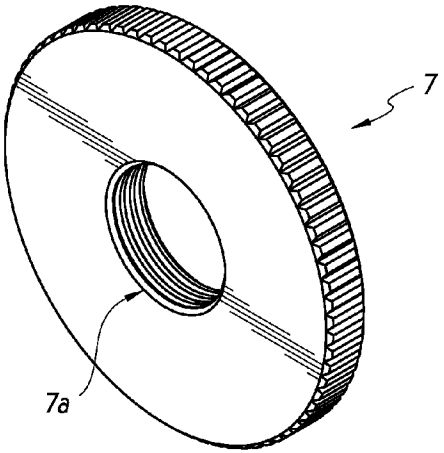
Figure 10B:
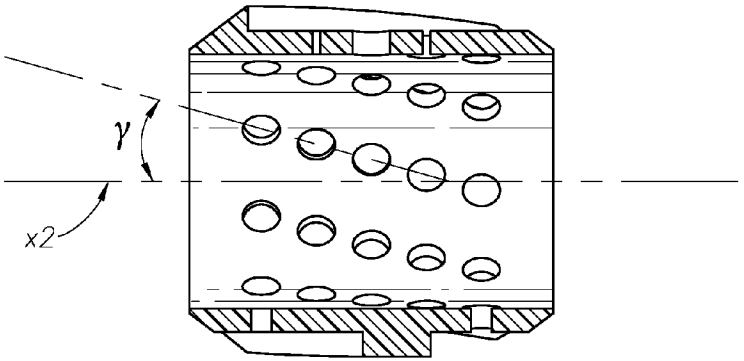
FIGS. 10A-10D are a perspective view and cross-sectional view of a spinner of the silencer assembly of FIG. 1.
Figure 10A:
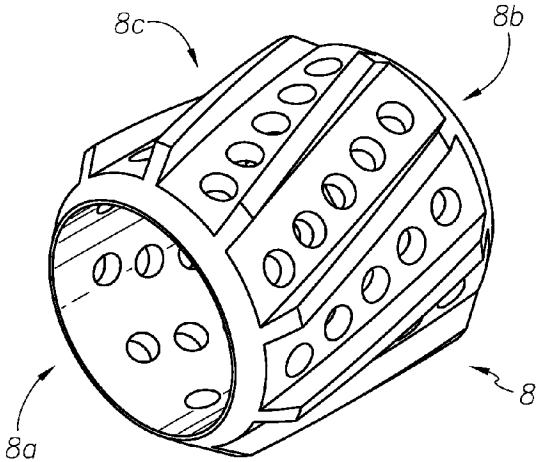
Figure 10D:
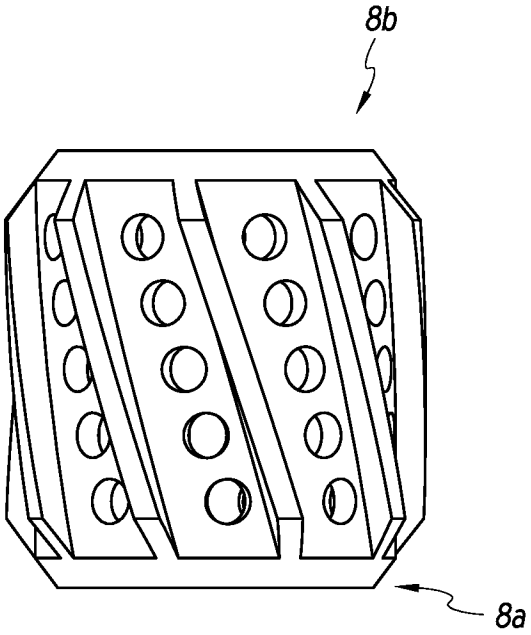
Figure 10C:
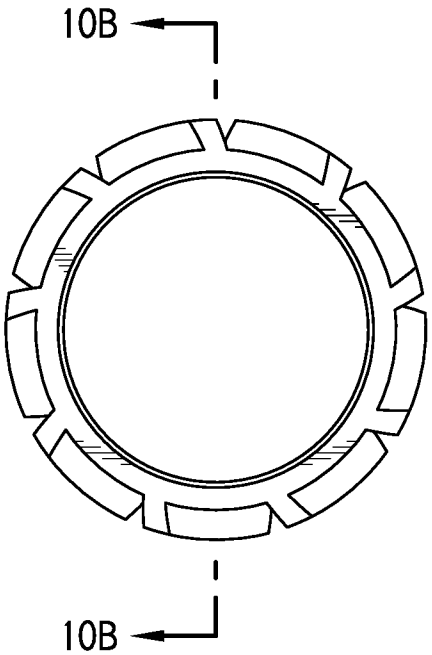
Figure 11B:
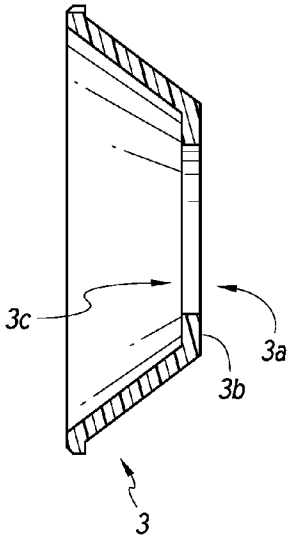
FIGS. 11A-11C are a perspective view and cross-sectional view of a chamber separator of the silencer assembly of FIG. 1.
Figure 11C:
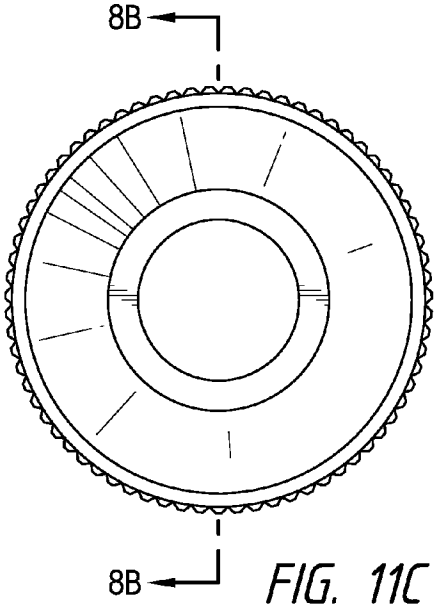
Figure 11A:
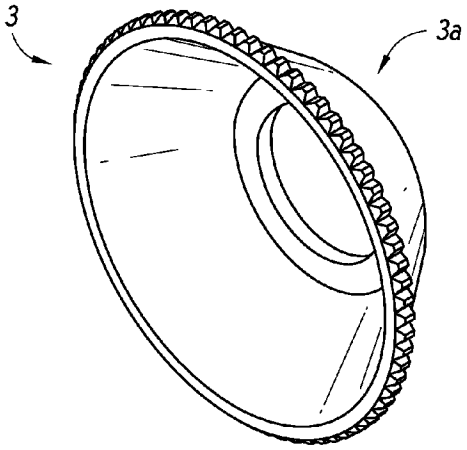
Figure 12B:
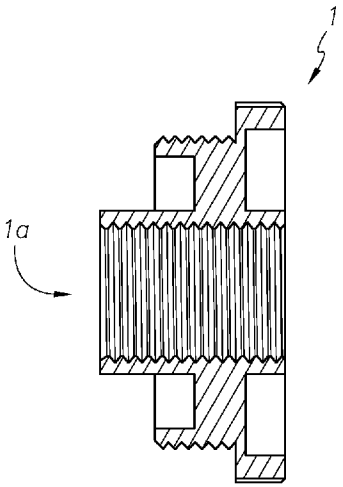
FIGS. 12A-12C are a perspective view and cross-sectional view of an adapter of the silencer assembly of FIG. 1.
Figure 12C:
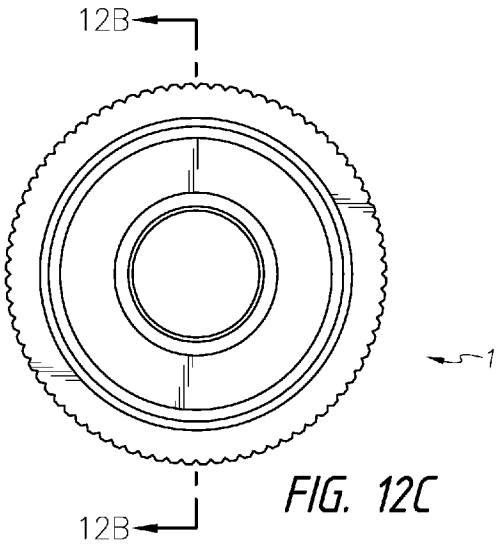
Figure 12A:
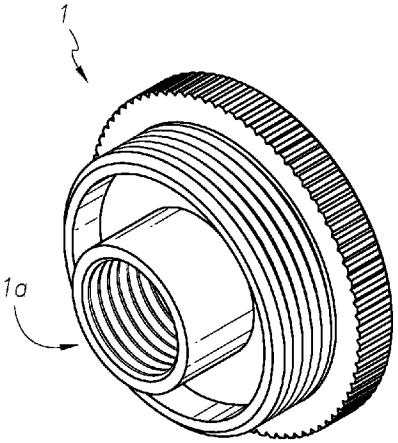

FIGS. 1-12C shows a modular silencer assembly 100. The assembly 100 includes an adapter or proximal cap 1 that can removably couple (e.g., via threads) to a proximal end 12 of a tube 10 (see FIGS. 4A-4C). The tube 10 can have a length L, which can optionally be approximately 5 inches, approximately 7 inches, approximately 9 inches, or approximately 11 inches. The tube 10 can have other suitable lengths L.

A rear or proximal expansion chamber 2' can be defined between a proximal tube portion 2 and an inner surface 11 of the tube 10. The proximal tube portion 2 can have a threaded end 2*a* (see FIGS. 5A-5D) that removably couples to a threaded coupling 1*a* (see FIGS. 12A-12C) of the adapter or proximal cap 1. The proximal tube portion 2 also has a reduced threaded end 2*b* that optionally extends through an opening 3*a* of a chamber separator 3 (see FIGS. 11A-11C) and a lip 2*c* that optionally abuts against a shoulder 3*b* of the chamber separator 3. The reduced threaded end 2*b* optionally extends within and couples to an end 4*a* of a center piece or intermediate tube portion 4 (see FIGS. 6A-6D). An opposite reduced end 4*b* of the center piece 4 optionally extends through another chamber separator 3 so that a lip 4*c* of the center piece 4 optionally abuts against a shoulder 3*b* of the chamber separator 3. An intermediate expansion chamber 4' can be defined between the center piece or intermediate tube portion 4 and the inner surface 11 of the tube 10. The opposite reduced end 4*b* of the center piece 4 can optionally extend within and couple to the end 4*a* of another center piece 4. Any number (e.g., a plurality) of center pieces or intermediate tube portions 4 and chamber separators 3 can be removably coupled, depending on the length of the tube 10 that houses the components of the silencer assembly 100.

In FIGS. 1-3C, the modular silencer assembly 100 has ten chamber separators 3 and nine center pieces or intermediate tube portions 4. However, this number can vary. The chamber separators 3 can optionally be cone shaped and face rearward toward the firearm (e.g., wide portion of cone faces away from firearm), which allows for reduced recoil and additional noise reduction. Optionally, an outermost edge of the chamber separator 3 can be knurled.

Once the last center piece or intermediate tube portion 4 has been coupled, a final chamber separator 3 is disposed over the reduced end 4*b* of said center piece 4 and said reduced end 4*b* can optionally extend into and couple to an end 5*a* of a distal tube portion 5 (see FIGS. 7A-7D). The distal tube portion 5 can have an opposite end 5*b* that can extend through an opening 6*a* in an end cap 6 (see FIGS. 8A-8C). A distal or front expansion chamber 5' can be defined between the distal tube portion 5 and the inner surface 11 of the tube 10.

The cap 6 can couple to an opposite end 14 of the tube 10. The opposite end 5*b* can threadably couple with a threaded opening 7*a* of a nut 7 (see FIGS. 9A-9C) that can be rotated adjacent the cap 6 to thereby complete the assembly of the modular silencer 100.

The proximal tube portion 2, intermediate tube portions 4 and distal tube portion 5 defined a continuous, uninterrupted center tube when assembled together that advantageously provides low back pressure, inhibits projectile buffeting, and achieves reduced or little blowback and greater shot accuracy.

The silencer 100 optionally defines bores in the various components (e.g., adapter, back expansion chamber, chamber separators, center pieces, front expansion chamber, end cap and nut) though which discharge from a muzzle of a gun barrel travels as the projectile (e.g., bullet) is fired through the silencer 100. Advantageously, the threaded coupling of the nut 7 on the end 5*b* of the distal tube portion 5 applies a tension force and stabilizes the components of the silencer assembly 100. Advantageously, this creates a tensile strength supported system that is stable, inhibits (e.g., prevents) heat related distortions or chamber separator strikes (e.g., strikes between the filed bullet and one or more chamber separators) during use of the silencer 100, is light weight, modular, and easy to clean and assemble.

The proximal tube portion 2, center pieces 4 and distal tube portion 5 can optionally have one or more angled openings or swirls 2*d*, 4*d*, 5*d* that extend through the wall of the proximal tube portion 2, center pieces 4 and distal tube portion 5, respectively. The proximal tube portion 2, center pieces 4 and distal tube portion 5 can optionally have multiple angled openings or swirls 2*d*, 4*d*, 5*d*. The one or more angled openings or swirls 2*d*, 4*d*, 5*d* can extend at an angle α relative to a central axis X1 (e.g., axis of symmetry) of the proximal tube portion 2, center pieces 4 and distal tube portion 5.

The one or more angled openings or swirls 2*d*, 4*d*, 5*d* can optionally extend at an angle of approximately 37 degrees relative to said axis. However, they can extend at other suitable angles. Advantageously, the one or more angled openings or swirls of the proximal tube portion 2, center pieces 4 and distal tube portion 5 facilitate a disruptive gas release pattern during operation (e.g., when a bullet is fired through the silencer 100), and optionally facilitate application of a left hand torque on the assembly 100 to retain the assembly 100 tightly secured to the muzzle of the firearm. Applicant has found that the silencer assembly 100 reduces the noise level to less than about 124 decibels, for example to about 100 decibels, which is much lower than the noise suppression performance of existing silencer designs. Alternatively, the angled openings or swirls can be excluded from the proximal tube portion 2, center pieces 4 and/or distal tube portion 5. Alternatively, a plurality of openings (e.g., in an array) can be formed through the walls of the proximal tube portion 2, center pieces 4 and/or distal tube portion 5 that are not angled relative to their central axes (e.g., axes of symmetry).

The end cap 6 can have a plurality of openings 6*b* (e.g., ventilation openings) along its outer periphery 6*c*, thereby allowing dispersion of heat and gas during use of the silencer assembly 100. Optionally, the plurality of openings 6*b* can be arranged at an angle relative to an axis of the end cap 6. The angle can optionally be approximately 37 degrees. However, other suitable angles can be used.

Optionally, the silencer assembly 100 can include a spinner (sleeve) 8 disposed about one or more of the center pieces 4. The spinner 8 can optionally have a beveled end 8*a* (see FIGS. 10A-10D) that can sit on a shoulder portion 3*c* of the chamber separator 3, and an opposite end 8*b*. The spinner 8 can optionally have a plurality of holes 8*c* on its body through which gas can pass. The spinner 8 can optionally have an array of holes 8*c* arranged in rows. Optionally, the holes 8*c* arranged in rows can be arranged to extend at an angle γ relative to the axis X2 (e.g., central axis, or axis of symmetry) of the spinner 8. The angle γ at which the rows of holes 8*c* extend can optionally be generally the same as the angle α of the one or more angled openings or swirls 2*d*, 4*d*, 5*d*. The spinner 8 can optionally freely spin or rotate about the axis of the center piece 4. Advantageously, rotation of the spinner 8 can disrupt gas flow and utilize the expended energy to spin and convert chemical energy into mechanical energy, thus dispersing heat and pressure and providing pressure wave reduction during use of the silencer 100, further dissipating heat and sound. Applicant has found that the silencer assembly of FIG. 1 has resulted in about a 20% increase in efficiency (e.g., in dissipating heat and sound).

An outer sleeve 20 can optionally be fastened over the tube 10 and attached to the adapter 1 and cap 6. Accordingly, the adapter 1 and cap 6 hold the outer sleeve 20 in place relative to the tube 10. Optionally, the outer sleeve 20 can be dimensioned so that it is radially spaced apart from the tube 10 to define an air gap therebetween. Alternatively, the outer sleeve 20 can be dimensioned to snuggly fit over the tube 10. Optionally, the outer sleeve 20 can be made of carbon fiber, which advantageously inhibits overheating of the outer surface of the silencer assembly 100 during use and inhibits burn injuries to users from touching the silencer assembly 100 following prolonged use (e.g., after firing hundreds of rounds of ammunition). Optionally, the outer sleeve 20 can have an inside diameter of about 1.5 inches and an outside diameter of between about 1.7 inches and about 1.75 inches. The outer sleeve 20 is preferably made of a carbon fiber material having low thermal conductivity to inhibit the sleeve 20 from heating up significantly during use of the silencer 100.

With continued reference to FIGS. 1-12C, once assembled in the tube 10 under tension, as described above, the outermost edge of the chamber separators 3 is spaced from the inner surface 11 of the tube 10 to advantageously allow for gas equalization between chambers, allowing the gasses to flow rearward in the silencer 100, thereby controlling and cooling expanding gases and equalizing pressures between the proximal, intermediate and distal expansion chambers. Optionally, the outermost edge of the chamber separators 3 is spaced from the inner surface 11 of the tube 10 by a gap G of approximately 0.001 inches. However, other suitable dimensions can be used. As discussed above, an outermost edge of the chamber separator 3 can be knurled. The knurled edge of the chamber separators 3, alone or in combination with the gap G, can advantageously facilitate laminar flow through the channels or grooves defined by the knurled edge (e.g., allowing flow of a plurality of gas jets via the channels or grooves), which allows for equalization of pressure between the chambers (e.g., chambers 2', 4', 5'), leading to enhanced noise suppression and/or heat dissipation.

As discussed above, the silencer assembly 100 is advantageously modular and can be assembled (e.g., in the field) in a variety of sizes, utilizing a correspondingly sized tube 10. For example, the silencer assembly 100 can be assembled in sizes between about 12 inches and about 5 inches, such as 11.5 in., 9.5 in., 7.5 in. and 5.5 in. The silencer assembly 100 can advantageously be disassembled in the field (without the use of tools) for ease of cleaning and maintenance. For example, the internal components of the silencer assembly 100 can be disassembled and one or more of the components (e.g., one or more of the proximal tube portion 2, intermediate tube portions 4, distal tube portion 5, chamber separators 3, and/or spinners 8 can be replaced). Additionally, as discussed above, the length of the silencer assembly 100 can be adjusted by incorporating a different number of the components (e.g., proximal tube portion 2, intermediate tube portions 4, distal tube portion 5, chamber separators 3, and/or spinners 8) in a tube 10 with different length L. Optionally, the components of the silencer assembly 100, except for the sleeve 20, can be made of Titanium (e.g., 6AL Titanium). The silencer assembly 100 can advantageously weigh less than 20 ounces.

Advantageously, the silencer assembly 100 can be used with different firearms (e.g., bolt action, direct impingement and piston guns), and with automatic or semiautomatic weapons, without requiring modification. In particular, the silencer assembly 100 does not require the use of an adjustable gas block, and can be used with supersonic and subsonic ammunition. Additionally, the silencer assembly 100 inhibits (e.g., prevents) muzzle flash.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An active gun silencer system, comprising:

a tube extending from a proximal end configured to couple to a gun barrel at a muzzle thereof to a distal end; and a modular assembly comprising a plurality of chamber separators axially spaced apart from each other by a plurality of separate tube portions within a bore of the tube and suspended within the tube under a tension force, each pair of adjacent chamber separators defining a chamber therebetween, wherein an outermost edge of each of the chamber separators is spaced apart from an inner surface of the tube by a gap to facilitate gas flow between the chambers, thereby facilitating gas equalization between chambers within the tube to thereby increase noise suppression.

2. The silencer of claim 1, wherein the gap is approximately 0.001 inches.

3. The silencer of claim 1, wherein the plurality of separate tube portions comprise a plurality of intermediate tube portions, each intermediate tube portion disposed between and interconnecting adjacent chamber separators, the plurality of intermediate tube portions releasably coupleable to each other under said tension force along an axis, each of the plurality of the tube portions having a central bore along its length and one or more openings extending through a wall of the intermediate tube portion configured to allow a gas to pass from the central bore into the chamber that surrounds the intermediate tube portion.

4. The silencer of claim 3, wherein the one or more openings extending through the wall of the intermediate tube portion are oriented at an angle relative to a central axis of the intermediate tube portion.

5. The silencer of claim 4, wherein the angle is approximately 37 degrees.

6. The silencer of claim 3, further comprising a sleeve rotatably disposed about one or more of the plurality of intermediate tube portions, the sleeve comprising one or more openings through a wall of the sleeve configured to allow the gas to pass through the sleeve into the chamber surrounding the intermediate tube portion, the sleeve configured to rotate relative to the intermediate tube portion to dissipate heat and sound generated by firing a bullet through the silencer.

7. The silencer of claim 6, wherein the one or more openings extending through the wall of the sleeve are oriented at an angle relative to a central axis of the sleeve.

8. The silencer of claim 7, wherein the angle is approximately 37 degrees.

9. The silencer of claim 3, further comprising a proximal expansion chamber between an adapter removably coupleable to a proximal end of the tube and a first of the plurality of chamber separators, a proximal tube portion disposed between and coupled to the adapter and first chamber separator, the proximal tube portion removably coupled to a first of the plurality of intermediate tube portions, and further comprising a distal expansion chamber between a last of the plurality of chamber separators and an end cap removably coupleable to a distal end of the tube, a distal tube portion disposed between and coupled to the end cap and the last chamber separator, the distal tube portion removably coupled to a last of the plurality of intermediate tube portions, wherein a distal end of the distal tube portion extends through an opening in the end cap such that it protrudes from the end cap.

10. The silencer of claim 9, wherein the end cap comprises a plurality of openings on a perimeter surface thereof through which gas can exit from the distal expansion chamber.

11. The silencer of claim 9, further comprising a nut configured to threadably couple to the distal end of the distal tube portion that protrudes from the end cap so that the end cap is disposed axially between the nut and the distal expansion chamber, wherein an amount of the tension force applied to the modular assembly depends on the degree to which the nut is threaded onto the distal end of the distal tube portion.

12. The silencer of claim 9, wherein the proximal tube portion, plurality of intermediate tube portions, and distal tube portion are sequentially threadably coupled to each other and together define a continuous bore configured to receive a bullet therethrough during use, and where a proximal end of the proximal tube portion is threadably coupled to a threaded coupling of the adapter, the threaded coupling defining a bore therethrough that aligns with a bore of the proximal tube portion.

13. The silencer of claim 1, further comprising an outer sleeve disposed over the tube, the outer sleeve made of carbon fiber material and configured to inhibit heat transfer from the tube during use of the silencer, thereby inhibiting burn injuries from contact with the outer sleeve.

14. The silencer of claim 1, wherein each of the plurality of chamber separators is cone shaped and tapers toward the proximal end of the tube.

15. An active gun silencer system, comprising:

a tube extending from a proximal end configured to couple to a gun barrel at a muzzle thereof to a distal end; and a modular assembly comprising an adapter removably coupleable to the proximal end of the tube, the adapter comprising a threaded coupling defining a bore therethrough, an end cap removably coupleable to the distal end of the tube, the end cap comprising a central opening therethrough, a plurality of cone-shaped chamber separators axially spaced apart within a bore of the tube, an outer perimeter of each chamber separator spaced from a surface of the bore by a gap, each pair of adjacent chamber separators defining a chamber therebetween, a proximal tube portion disposed between the adapter and a first of the plurality of chamber separators, a proximal expansion chamber defined between the adapter and the first of the plurality of chamber separators, the proximal tube portion threadably coupled to the threaded coupling of the adapter and having a central bore along its length, a plurality of intermediate tube portions, each intermediate tube portion disposed between and interconnecting adjacent chamber separators, the plurality of tube portions threadably coupleable to each other along an axis, each of the plurality of the intermediate tube portions having a central bore along its length and one or more openings extending through a wall of the intermediate tube portion configured to allow gas to pass from the central bore of the intermediate tube portion into the chamber that surrounds the intermediate tube portion, a first of the plurality of intermediate tube portions threadably coupleable to a distal end of the proximal tube portion, a plurality of sleeves, each sleeve rotatably disposed about one of the plurality of intermediate tube portions, the sleeve comprising one or more openings through a wall of the sleeve configured to allow gas to pass from the central bore of the intermediate tube portion into the chamber that surrounds the intermediate tube portion, the sleeve configured to rotate relative to the intermediate tube portions, a distal tube portion disposed between a last of the plurality of chamber separators and the end cap, a distal expansion chamber defined between the last of the plurality of chamber separators and the end cap, the distal tube portion threadably coupled to a last of the plurality of intermediate tube portions, a distal end of the distal tube portion configured to extend through the central opening in the end cap such that the distal end protrudes from the end cap, and a nut configured to threadably couple to the distal end of the distal tube portion so that the end cap is disposed axially between the nut and the distal expansion chamber, wherein the proximal tube portion, plurality of intermediate tube portions, and distal tube portion, when threadably assembled define a continuous central bore of the silencer through which a bullet can pass, wherein the nut applies a tension force on the modular assembly based on a degree to which the nut is threaded onto the distal end of the distal tube portion and bears against the end cap, and wherein the gap between the plurality of chamber separators and the inner surface of the tube facilitates gas equalization between chambers within the tube to thereby dissipate heat and increase noise suppression during use.

16. The silencer of claim 15, wherein the gap is approximately 0.001 inches.

17. The silencer of claim 15, wherein the openings extending through the wall of the intermediate tube portions and the openings extending through the wall of the sleeves are oriented at an angle relative to a central axis of the intermediate tube portions.

18. The silencer of claim 17, wherein the angle is approximately 37 degrees.

19. The silencer of claim 15, wherein the end cap comprises a plurality of openings on a perimeter surface thereof through which gas can exit from the distal expansion chamber.

20. The silencer of claim 15, further comprising an outer sleeve disposed over the tube, the outer sleeve made of carbon fiber material and configured to inhibit heat transfer from the tube during use of the silencer, thereby inhibiting burn injuries from contact with the outer sleeve.

* * * * *